US006938804B2

(12) United States Patent
Chen

(10) Patent No.: US 6,938,804 B2
(45) Date of Patent: Sep. 6, 2005

(54) DISPENSING APPARATUS

(75) Inventor: Lianrui Chen, Tianjin (CN)

(73) Assignees: Li Jie, Tianjin (CN); Tianjin Jinmao Corp., Ltd., Tianjin (CN)

( * ) Notice: Subject to any disclaimer, the term of this patent is extended or adjusted under 35 U.S.C. 154(b) by 0 days.

(21) Appl. No.: 10/777,047

(22) Filed: Feb. 13, 2004

(65) Prior Publication Data

US 2004/0195271 A1 Oct. 7, 2004

(30) Foreign Application Priority Data

Mar. 11, 2003 (CN) ..... 03240344 U

(51) Int. Cl.[7] ..... B67D 5/42
(52) U.S. Cl. ..... 222/391; 222/327
(58) Field of Search ..... 222/391, 386, 222/326–327, 137; 74/141.5, 112, 116, 148, 169, 156, 160, 491, 523

(56) References Cited

U.S. PATENT DOCUMENTS 4,009,804 A * 3/1977 Costa et al. ..... 222/391
4,471,888 A * 9/1984 Herb et al. ..... 222/137
5,052,243 A * 10/1991 Tepic ..... 74/523
5,137,181 A 8/1992 Keller ..... 222/134
5,390,831 A * 2/1995 Schneider ..... 222/391
5,392,956 A 2/1995 Keller ..... 222/1
5,499,548 A 3/1996 Keller ..... 74/96
5,823,403 A * 10/1998 Schneider ..... 222/391
5,992,694 A 11/1999 Keller ..... 222/137
6,155,463 A * 12/2000 Dentler ..... 222/165
6,260,737 B1 7/2001 Gruendeman ..... 222/391
6,325,249 B1 12/2001 Keller ..... 222/137
6,691,899 B2 * 2/2004 Sung ..... 222/391
6,766,923 B1 * 7/2004 Huang ..... 222/327
2004/0206784 A1 * 10/2004 Chen ..... 222/391

* cited by examiner

*Primary Examiner*—Frederick C. Nicolas
(74) *Attorney, Agent, or Firm*—Baker & Hostetler LLP

(57) ABSTRACT

A dispensing apparatus including a main body with a fixed handle, a push rod, a gun body uniting section, and a trigger is disclosed.

19 Claims, 2 Drawing Sheets

DISPENSING APPARATUS

TECHNICAL FIELD

The present invention relates to an ejector device in the field of conventional spraying or surface coating, i.e., a dispensing apparatus, and especially to a feeding device for an apparatus, such as a handheld dispensing gun or a push rod thereof.

BACKGROUND ART

The conventional feeding device for a hand caulking gun, such as that disclosed in the Chinese Patent No. 00257653.8, titled "A Feeding Device of a Caulking Gun," provides a caulking gun with a structure that can receive a caulk cartridge. The caulking gun comprises a main body, which is formed with two parallel hollowed parts. A fixed handle is protruded from one of the hollowed parts and a trigger is pin-jointed thereon. A push rod passes through the main body. Springs, a deflector rod and a brake bar are provided respectively in the two hollowed parts. It is passable that the feeding device for a caulking gun with such structure be used to the common caulk cartridge. But when the feeding device is used for double caulk cartridges or high capacity caulk cartridge, it is more laborsome.

Various other patents teach conventional dispensing apparatuses and methods. For example, U.S. Pat. Nos. 5,137,181 and 5,992,694 disclose a manually operated two-component dispensing cartridge with two rams between a thrust member is disposed in cylindrical sliding guides. Pivotably attached to the thrust member are ratchets, pawls of which engage with an indentation extending on either side of the ram to move the rams, including the thrust pieces, in the direction of the cartridges.

U.S. Pat. No. 5,392,956 discloses a method for advancing two or more rods against a resistance typically encountered in dispensing devices for multiple component dispensing by using thrust rods seized by clamping levers in a traveller advanced along with a traveller. The thrust rods extend through the traveller and a clamping lever.

U.S. Pat. No. 5,499,548 discloses a movable actuating lever connected to a transmission lever guided by means of a pin in a guideway in the apparatus housing. The position and shape of the guiding groove and lever help optimally adapt the course of motion of the actuating lever with respect to a fixed handle portion to achieve an effective force transmission with minimal frictional losses.

U.S. Pat. No. 6,260,737 discloses a dispenser for manually dispensing pasty, semi-fluid products from a cartridge, where the dispenser incorporates an integral trigger and pawl plunger drive mechanism in which the drive is activated by a trigger. A floating griper is disposed on the plunger, or trigger, to release dispensing pressure to prevent drooling after the completion of dispensation.

U.S. Pat. No. 6,325,249 discloses a manually operated dispensing device for use with a double cartridge with two thrust ram parts each having a toothed surface, as well as a drive assembly for acting on the double thrust ram actuated by a trigger lever. The drive assembly includes a drive member with teeth to act on the double thrust ram.

Thus, there is a long-felt need in the art to make dispensing guns easier to handle and to provide the dispensing gun and its users with more features and utility.

SUMMARY OF THE INVENTION

The invention relates to a dispensing apparatus feeding device that includes a main body including a push rod oriented longitudinally through the dispensing apparatus, wherein the push rod includes a forwarding piece a forward end and a knob at a rearward end, a first section which includes a connecting plate, a second section which includes a coupling attached to the main body by a driving shaft and having a hindered bulge on a side of the coupling, a connecting part at a lower end of the coupling that is adapted and configured to connect with the connecting plate, and a hole in a center of the coupling to receive the driving shaft. The central portion of the coupling includes a first recess adapted to receive one or more driving pieces, at least one of which includes an upper through-hole adapted to receive the push rod and permit it to pass therethrough and a lower through-hole to receive a bulge of a spacing block, and a second recess adapted to receive a braking piece that cooperates with a braking bumper pin provided on the main body, with each recess being disposed adjacent the hole and on opposite sides thereof, a gun body uniting section, and a fixed handle including an active trigger pin-jointed thereon that has a curving portion adapted to receive fingers. The connecting plate is typically rotatably attached at one end to an upper end of the trigger while the other end of the connecting plate is rotatably attached with a lower end of the coupling, with a spring-catching flange for catching a first spring being provided in a central part of the connecting plate. Also, the push rod generally passes through the gun body uniting section, and passes successively through the braking piece, a second spring, the upper through hole in the driving pieces, a third spring, and a spring-catching piece in the second section of the main body.

In one embodiment, the coupling is pin-jointed to the second section, the active trigger is pin-jointed to the fixed handle, and the rotatable attachments each include a hinge. In another embodiment, the connecting part includes a hinging hole. In yet another embodiment, the main body further includes an adjusting screw having a length of the driving pieces. In one embodiment, the dispensing apparatus further includes an adjusting screw arranged so that the push rod and the driving pieces tend to be perpendicular to each other.

In one embodiment, the driving pieces and the braking piece include the same structure, and the driving pieces include two which are assembled via the spacing block. In a preferred embodiment, the gun body uniting section includes an assembling hole that can connect a union screw and a single-sided plate. In another preferred embodiment, the main body includes a rib flange. In yet another preferred embodiment, a sheath is mounted adjacent where the push rod further passes through the main body in a back part thereof.

The invention also relates to a dispensing apparatus including a push rod oriented longitudinally through the dispensing apparatus that comprises a forwarding piece to advance a portion of the cartridge at a forward end to dispense pasty fluid therefrom, a fixed handle including an active trigger pin-jointed thereon that has a curving portion adapted to receive fingers to facilitate accurate dispensing, a connecting plate that rotatably connects an upper end of the active trigger to a rotatable coupling having a hindered bulge on a side to hinder counter-clockwise motion thereof, and that includes a spring-catching flange for catching a first spring being provided in a central part of the connecting plate, and a main body attached to the coupling and being adapted and configured to advance the push rod via a driving shaft that is operatively associated to the push rod, wherein the coupling includes a plurality of recesses adapted to receive one or more driving pieces and at least one braking piece.

In one embodiment, the braking piece is internal to the main body and adjacent to the coupling. In another embodiment, the coupling is connected at a lower end with the connecting plate. In yet another embodiment, the coupling includes a hole in a center thereof to receive the driving shaft.

In one embodiment, the plurality of recesses are provided in a central portion of the coupling. In a preferred embodiment, the plurality of recesses are provided on opposing sides of the coupling. In another embodiment, the push rod passes through a gun body uniting section, and successively through the at least one braking piece, a second spring, the at least one recess in the driving pieces, a third spring, and a spring-catching piece in the second section of the main body. In one preferred embodiment, the apparatus is a caulk gun and the pasty fluid includes caulk.

BRIEF DESCRIPTION OF DRAWINGS

Further features and advantages of the invention can be ascertained from the following detailed description that is provided in connection with the drawing(s) described below.

DETAILED DESCRIPTION OF THE PREFERRED EMBODIMENTS

Figure 1:
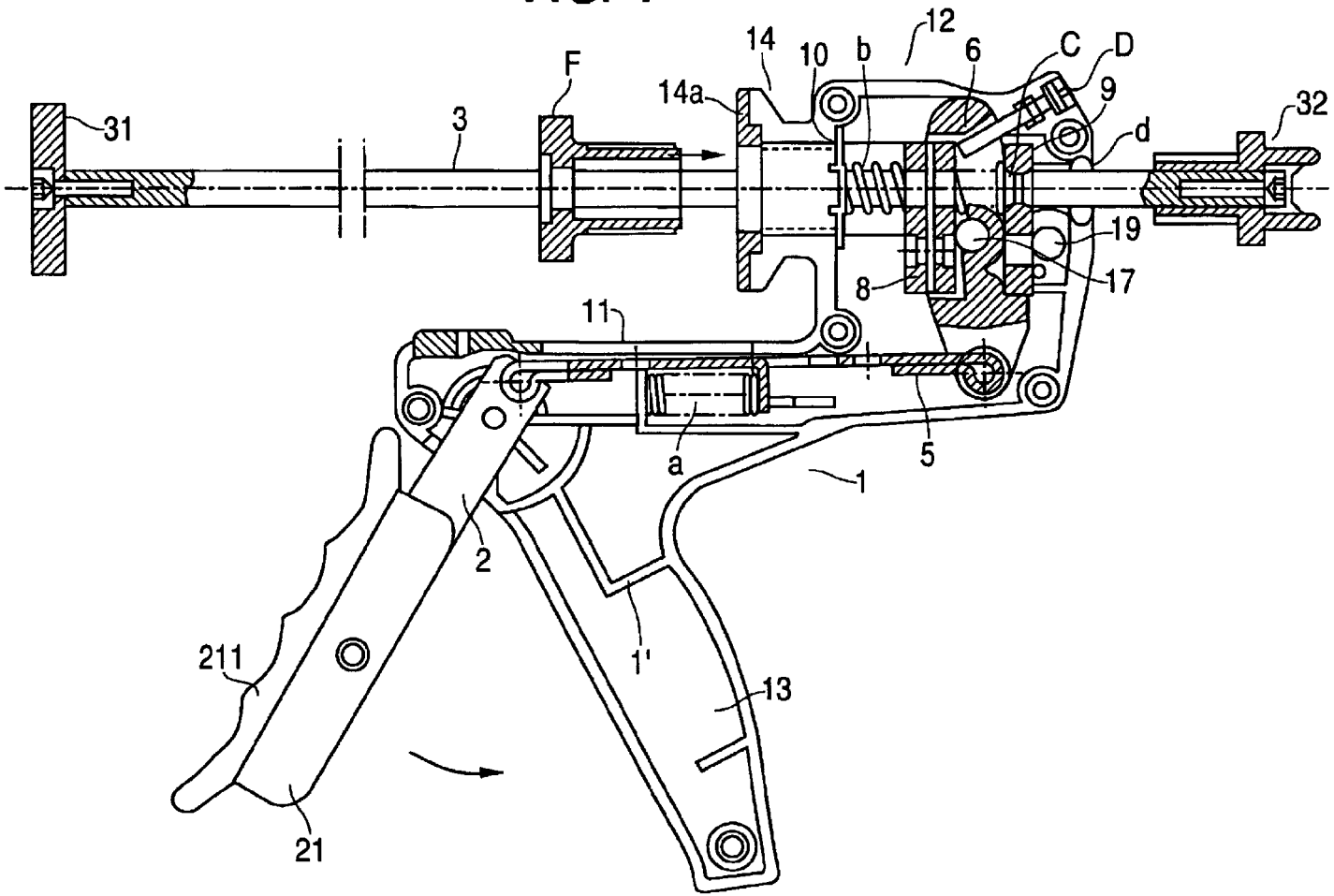
FIG. 1 is a structural representation of the present invention.

The present invention provides a dispensing apparatus, such as a caulking gun, that is more easily handled than conventional devices, such as by providing a novel feeding device. The feeding device for a dispensing gun of the invention includes a labor saving brake device via a connecting lever to minimize the labor required to operate the dispensing gun, provides an active trigger to improving the gripping effect, and provides an adjusting screw to facilitate fine adjustment of the dispensing gun. The labor saving brake device advantageously inhibits or prevents backward slippage of the push rod of the dispensing device. The active trigger 21 can optionally but preferably pivot for comfort, include pre-shaped finger receiving portions, or both, to help make the dispenser more accurate during use. Preferably, the dispensing apparatus is adapted and configured to provide for single-cartridge dispensing.

The benefits of the present invention are obtained by the following technical solution:

A feeding device for a dispensing gun, such as a caulking apparatus, including a main body (1) with a fixed handle, a push rod (3) and a trigger (2), wherein:

The main body includes a first section, a second section, a gun body uniting section, and a handhold;

A trigger is pin-jointed on the fixed handle of the main body, an active trigger is pin-jointed on the trigger and a curving portion which is suitable for fingers to hold is formed on the active trigger;

A connecting plate is provided in the first section of the main body, and one end of the connecting plate is hinged with the upper end of the trigger, while the other end of the connecting plate is hinged with the lower end of a coupling, a spring-catching flange for catching a first spring is provided in the central part of the connecting plate;

The abovementioned coupling is pin-jointed on the second section of the main body by a driving shaft, a hindered bulge is formed on a side surface of the coupling, a connecting part suitable for connecting with the connecting plate is formed at the lower end of the coupling, a hinging hole for connecting with the connecting plate is formed at the connecting part, a hole is provided at the center of the coupling for receiving the driving shaft; in the central part of the coupling, a first recess for receiving a driving pieces and a second recess for receiving a braking piece are reserved on two sides of the hole separately; an upper through-hole for allowing the push rod pass through and a lower through-hole for receiving a bulge of a spacing block are formed in the driving pieces;

The abovementioned push rod is provided horizontally and passes through the second section of the main body and the gun body uniting section and passes successively through the braking piece, a second spring, the driving pieces, a third spring and a spring-catching piece in the second section of the main body; a forwarding piece is provided at the front end of the push rod and a knob at the back end; the braking piece cooperates with a braking bumper pin provided on the main body.

The benefits of the present invention can also be obtained by the following features according to the invention.

In the abovementioned feeding device of a dispensing gun, an adjusting screw which has the length sufficient to contact at least one of, and preferably all of, the driving pieces is operatively associated with the main body. Preferably, the adjusting screw is provided on the main body.

In the abovementioned feeding device of a dispensing gun, the driving pieces and the braking piece have the same structure, and the driving pieces include two items which are assembled via the spacing block.

In the abovementioned feeding device of a dispensing gun, the gun body uniting section reserves an assembling hole which can join with a union screw and couple with a single-sided plate.

In the abovementioned feeding device of a dispensing gun, a rib flange is formed in the main body.

In the abovementioned feeding device of a dispensing gun, in the back part of the main body, a sheath is mounted at the place where the push rod passes through the main body.

The following advantages and positive effects can be understood from the above technical solutions.

The main contribution of the present invention is to provide a feeding device that makes the operation of a dispensing gun easier. The feeding device of a dispensing gun drives the coupling moving by the connecting plate and makes it easier to handle the dispensing gun, provides the users with facilities and makes the products more humanized, e.g., adapted and configured for the comfort, ease, and/or accuracy of human use. The present invention provides an adjusting screw to keep the push rod and the driving pieces perpendicular to each other and no blocking when assembling the products or in other desired conditions.

A PREFERRED EMBODIMENT OF THE INVENTION

Hereinafter a detailed illustration of the structure, features and effects of the captioned dribble prevention dispensing gun will be provided with reference to the drawings and the preferable example.

As shown in FIGS. 1 to 8, a feeding device of a dispensing gun can be combined with a gun body for receiving dispensing cartridges to form a dispensing gun. The dispensing cartridges can contain any flowable material desired to be dispensed, preferably a pasty, sticky, flowable material. In a preferred embodiment, the cartridges of the dispensing apparatus are configured and adapted to contain caulk. As shown primarily in FIG. 1, the feeding device of dispensing gun includes:

A main body 1, which has generally the shape of a gun, can be made by assembling two half carasses which have symmetric structure and are casting-molded at one time. The two half-portions can be formed by any suitable conventional process, but preferably they are each made by cast-molded. The main body includes a forward-protruding first section 11, a second section 12 which is typically perpendicular to the first section, a gun body uniting section 14 extending forward from the second section of the main body to form a convex, which provides a single-sided plate 14*a* at the front end thereof and can combine with a union screw F to assemble the gun body, and a fixed handle 13 extending downward from the first section 11 of the main body. The gun body uniting section 14 can form a convex portion, and the combination of single-sided plate 14*a* and union screw F can inhibit or prevent separation of the first and second sections 11, 12 of the gun. A trigger 2 is pin-jointed on the fixed handle of the main body by a pin and the trigger 2 can perform advance and return movement relative to the fixed handle 13. An active trigger 21 which form a curving portion 211 suitable for fingers to hold is pin jointed on the trigger and the active trigger 21 can perform a motion relative to the trigger in a lower range to provide the users more comfort when holding it. A rib flange 1' is formed in the main body to enhance the strength of the main body. A connecting plate 5 is provided in the first section of the main body, and one end of the connecting plate is hinged with the upper end of the trigger by a pin, while the other end of the connecting plate is hinged with the lower end of a coupling 6 by a pin. A spring-catching flange 51 for catching a first spring a is provided in the central part of the connecting plate 5.

Figure 2:
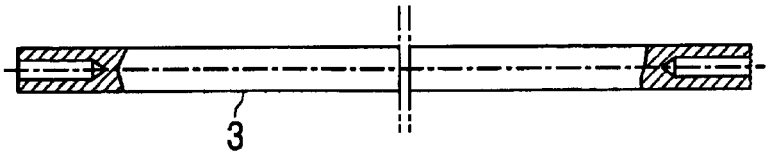
FIG. 2 is a structural representation of the push rod in the present invention.

FIG. 2 illustrates the push rod 3 of the present invention, which is at least substantially smooth, preferably smooth, and does not contain ratchets or the like. By "substantially smooth" it is meant that no deliberate notches, grooves, or pawls are included in the surface that have the effect of substantially facilitating the advancement of the push rod 3 during operation of the apparatus in the manner of a ratchet. The surface of the push rod 3 may still contain a sanded or otherwise rough surface if desired that is sufficient to increase the coefficient of friction of the push rod to facilitate advancement.

Figure 3:
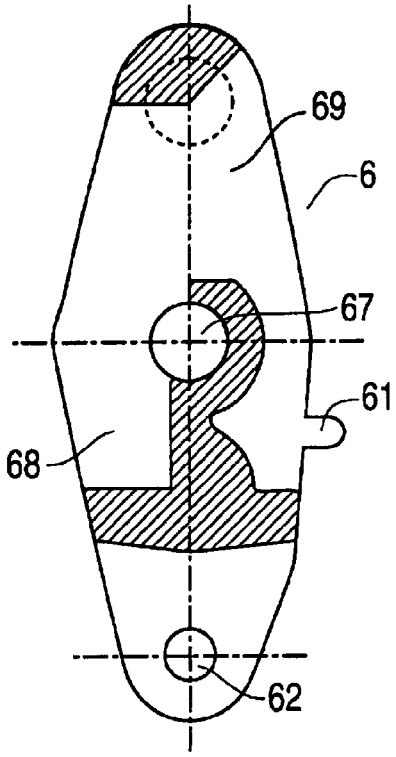
FIG. 3 is a structural representation of the coupling in the present invention.

FIG. 3 illustrates the coupling 6 of the present invention. The coupling 6 has a generally diamond shape and is pin jointed on the second section of the main body by the driving shaft 17, and provides a hindered bulge 61 on at least one side, or flanks, and forms a connecting part suitable for the connection with the connecting plate in its lower end part, in which a hinging hole 62 for connecting with the connecting plate is formed. The coupling part also includes a hole 67 for receiving the driving shaft 17. In the central part of the coupling 6, a first recess 68 for receiving the driving pieces 8 and a second recess 69 for receiving a braking piece 9 are reserved separately to the either side of the hole 67.

Figure 4:
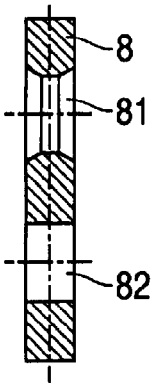
FIG. 4 is a structural representation of the driving pieces in the present invention.

FIG. 4 illustrates the driving pieces 8 of the present invention. An upper through-hole 81 for allowing the push rod pass through and a lower through-hole 82 for receiving a bulge 831 of a spacing block 83 are formed in the driving pieces 8. The driving pieces 8 and the braking piece 9 have the same structure, and the driving pieces 8 include two items which assembled via the spacing block 83, which is itself depicted in FIG. 6.

Figure 5:
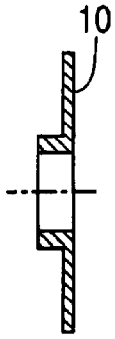
FIG. 5 is a structural representation of the spring-catching piece in the present invention.
Figure 6:
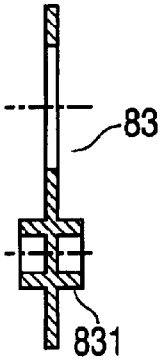
FIG. 6 is a structural representation of the spacing block in the present invention.
Figure 7:
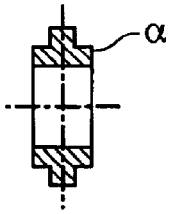
FIG. 7 is a structural representation of the insert block in the present invention.
Figure 8:
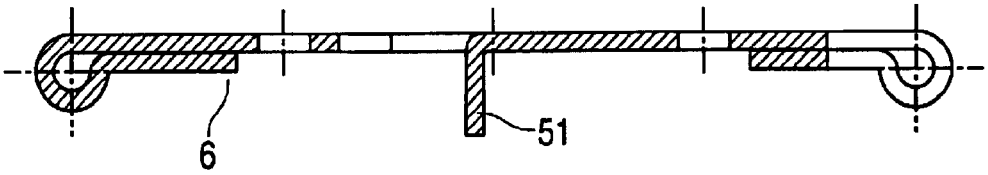
FIG. 8 is a structural representation of the connecting plate in the present invention.

The push rod 3 is provided horizontally through the second section 12 of the main body and the gun body uniting section 14 and passes successively through the braking piece 9, a second spring b, the driving pieces 8, a third spring c and a spring-catching piece 10 of FIG. 5 in the second section. The push rod 3 provides a forwarding piece 31 at its front end and a knob 32 at its back end. The braking piece cooperates with a braking bumper pin 19 provided on the main body. In the back part of the main body, FIG. 7 depicts an insert block d which serves as a sheath that is mounted where the push rod passes through the main body. An adjusting screw D just contacting the driving pieces 8 is provided on the upper back part of the main body. The driving pieces 8 can be adjusted fine by screwing the screw with a screwdriver to keep the push rod and the driving pieces perpendicular and no blocking.

As noted above, a spring-catching flange 51 for catching a first spring a is provided in the central part of the connecting plate 5. This is depicted more clearly in FIG. 8.

While the present invention has been shown and described with reference to certain preferred embodiments thereof, it will be understood by those skilled in the art that various changes in form and details may be made therein without departing from the spirit and scope of the present invention as defined by the appended claims. The foregoing embodiments and advantages are merely exemplary and are not to be construed as limiting the present invention. The description of the present invention is intended to be illustrative, and not to limit the scope of the claims. Many alternatives, modifications, and variations will be apparent to those skilled in the art. Thus, it is intended that the present invention cover the modifications and variations of this invention provided they come within the scope of the appended claims and their equivalents.

What is claimed is:

1. A dispensing apparatus feeding device that includes a main body comprising:

a push rod oriented longitudinally through the dispensing apparatus, wherein the push rod comprises a forwarding piece a forward end and a knob at a rearward end;

a first section which comprises a connecting plate;

a second section which comprises a coupling attached to the main body by a driving shaft and having a hindered bulge on a side of the coupling, a connecting part at a lower end of the coupling that is adapted and configured to connect with the connecting plate, and a hole in a center of the coupling to receive the driving shaft, wherein a central portion of the coupling comprises:

a first recess adapted to receive one or more driving pieces, at least one of which comprises an upper through-hole adapted to receive the push rod and permit it to pass therethrough and a lower through-hole to receive a bulge of a spacing block; and a second recess adapted to receive a braking piece that cooperates with a braking bumper pin provided on the main body, with each recess being disposed adjacent the hole and on opposite sides thereof;

a gun body uniting section; and a fixed handle comprising an active trigger pin-jointed thereon that has a curving portion adapted to receive fingers, wherein the connecting plate is rotatably attached at one end to an upper end of the trigger while the other end of the connecting plate is rotatably attached with a lower end of the coupling, with a spring-catching flange for catching a first spring being provided in a central part of the connecting plate, and wherein the push rod passes through the gun body uniting section, and passes successively through the braking piece, a second spring, the upper through hole in the driving pieces, a third spring, and a spring-catching piece in the second section of the main body.

2. The dispensing apparatus of claim 1, wherein the coupling is pin-jointed to the second section, the active trigger is pin-jointed to the fixed handle, and the rotatable attachments each comprise a hinge.

3. The dispensing apparatus of claim 1, wherein the connecting part comprises a hinging hole.

4. The dispensing apparatus of claim 1, wherein the main body further comprises an adjusting screw having a length sufficient to contact the driving pieces.

5. The dispensing apparatus of claim 1, which further comprises an adjusting screw arranged so that the push rod and the driving pieces tend to be perpendicular to each other.

6. The dispensing apparatus of claim 1, wherein the driving pieces and the braking piece comprise the same structure, and the driving pieces include two which are assembled via the spacing block.

7. The dispensing apparatus of claim 6, wherein the gun body uniting section comprises an assembling hole that can connect a union screw and a single-sided plate.

8. The dispensing apparatus of claim 7, wherein the main body comprises a rib flange.

9. The dispensing apparatus of claim 8, wherein in a back part of the main body, a sheath is mounted adjacent where the push rod further passes through the main body.

10. A single-cartridge dispensing apparatus comprising the feeding device of claim 1.

11. A dispensing apparatus which comprises:

a push rod oriented longitudinally through the dispensing apparatus, wherein the push rod comprises a forwarding piece to advance a portion of the cartridge at a forward end, and a knob at a rearward end;

a first section which comprises a connecting plate that connects an active trigger to a coupling;

a second section comprises the coupling attached to the main body by a driving shaft and having a hindered bulge on a side of the coupling that hinders counter-clockwise motion of the coupling, the coupling being connected at a lower end with the connecting plate, and a hole in a center of the coupling to receive the driving shaft, wherein a central portion of the coupling comprises:

a first recess adapted to receive one or more driving pieces, at least one of which comprises an upper through-hole adapted to receive the push rod and permit it to pass therethrough and a lower through-hole to receive a bulge of a spacing block; and a second recess adapted to receive a braking piece that cooperates with a braking bumper pin provided on the main body, with each recess being disposed adjacent the hole and on opposite sides thereof; and a fixed handle comprising the active trigger pin-jointed thereon that has a curving portion adapted to receive fingers, wherein the connecting plate is rotatably attached at one end to an upper end of the trigger while the other end of the connecting plate is rotatably attached with a lower end of the coupling, with a spring-catching flange for catching a first spring being provided in a central part of the connecting plate, and wherein the push rod passes through a gun body uniting section, and successively through the braking piece, a second spring, the upper through hole in the driving pieces, a third spring, and a spring-catching piece in the second section of the main body.

12. A dispensing apparatus comprising:

a push rod oriented longitudinally through the dispensing apparatus that comprises a forwarding piece to advance a portion of the cartridge at a forward end to dispense pasty fluid therefrom;

a fixed handle comprising an active trigger pin-jointed thereon that has a curving portion adapted to receive fingers to facilitate accurate dispensing;

a connecting plate that rotatably connects an upper end of the active trigger to a rotatable coupling having a hindered bulge on a side to hinder counter-clockwise motion thereof, and that includes a spring-catching flange for catching a first spring being provided in a central part of the connecting plate; and a main body attached to the coupling and being adapted and configured to advance the push rod via a driving shaft that is operatively associated to the push rod, wherein the coupling comprises a plurality of recesses adapted to receive one or more driving pieces and at least one braking piece.

13. The dispensing apparatus of claim 12, wherein the braking piece is internal to the main body and adjacent to the coupling.

14. The dispensing apparatus of claim 12, wherein the coupling is connected at a lower end with the connecting plate.

15. The dispensing apparatus of claim 12, wherein the coupling comprises a hole in a center thereof to receive the driving shaft.

16. The dispensing apparatus of claim 12, wherein the plurality of recesses are provided in a central portion of the coupling.

17. The dispensing apparatus of claim 12, wherein the plurality of recesses are provided on opposing sides of the coupling.

18. The dispensing apparatus of claim 12, wherein the push rod passes through a gun body uniting section, and successively through the at least one braking piece, a second spring, the at least one recess in the driving pieces, a third spring, and a spring-catching piece in the second section of the main body.

19. The dispensing apparatus of claim 12, wherein the apparatus comprises a caulk gun and the pasty fluid comprises caulk.

* * * * *

UNITED STATES PATENT AND TRADEMARK OFFICE

CERTIFICATE OF CORRECTION

PATENT NO. : 6,938,804 B2
DATED : September 6, 2005
INVENTOR(S) : Lianrui Chen

It is certified that error appears in the above-identified patent and that said Letters Patent is hereby corrected as shown below:

Title page,
Item [73], Assignee, replace "Li Jie" with -- Jie Li --.

Signed and Sealed this

Tenth Day of January, 2006

JON W. DUDAS
*Director of the United States Patent and Trademark Office*